US005791332A

United States Patent [19]

Thompson et al.

[11] Patent Number: 5,791,332

[45] Date of Patent: Aug. 11, 1998

[54] VARIABLE SPEED INDUCER MOTOR CONTROL METHOD

[75] Inventors: Kevin D. Thompson, Indianapolis; Hall Virgil, Jr., Brownsburg, both of Ind.

[73] Assignee: Carrier Corporation, Syracuse, N.Y.

[21] Appl. No.: 602,436

[22] Filed: Feb. 16, 1996

[51] Int. Cl.[6] ..... F24H 3/00

[52] U.S. Cl. ..... 126/116 A; 431/12; 431/20

[58] Field of Search ..... 431/18, 12, 20; 126/110 R, 116 R, 116 A

[56] References Cited

U.S. PATENT DOCUMENTS

| | | | |
|---|---|---|---|
| 4,251,025 | 2/1981 | Bonne et al. | 431/12 |
| 4,703,747 | 11/1987 | Thompson et al. | 126/112 |
| 4,729,207 | 3/1988 | Dempsey et al. | 126/116 A |
| 5,027,789 | 7/1991 | Lynch | 431/20 |
| 5,075,608 | 12/1991 | Erdman et al. | 318/599 |
| 5,331,944 | 7/1994 | Kujawa et al. | 126/110 R |
| 5,418,438 | 5/1995 | Hollenbeck . | |
| 5,447,414 | 9/1995 | Nordby et al. . | |
| 5,557,182 | 9/1996 | Hollenbeck et al. | 318/432 |
| 5,616,995 | 4/1997 | Hollenbeck | 318/432 |
| 5,682,826 | 11/1997 | Hollenbeck | 110/147 |

*Primary Examiner*—Carl D. Price

[57] ABSTRACT

The present invention is a method and apparatus for controlling the flow of combustion air and/or combustion products through a furnace which may experience changing flow restrictions. The method provides constant flow through an induced-draft furnace by determining torque values applied to an inducer motor of the furnace from a lookup table, which is established by operating a test furnace under changing flow restrictions, typically by measuring furnace flue gas carbon monoxide concentration. A lookup table according to the invention may include motor operating performance plots for controlling inducer speed under operating conditions, and threshold plots, which may be employed for determining activation of furnace events such as ignition, gas valve energizing, and shutdown. In an adaptive method of the invention, an adaptive lookup table is provided by averaging torque values from each of several lookup tables. A pressure switch is provided having an opening pressure commensurate with a minimum excess air level. The pressure switch has a closing pressure which determines a torque biasing level for the furnace based on motor RPM and torque values determined from the adaptive lookup table.

21 Claims, 13 Drawing Sheets

A
B
YES
124
IS HIGH STAGE INPUT ON?
NO
126
READ RPM AND MOTOR TORQUE MT
128
DETERMINE MT(Is) MT(Ith) and MT(hth)
130
CHANGE MTR. TORQUE TO MT(Is)
168
READ RPM AND MOTOR TORQUE MT
164
IS MOTOR TORQUE MT <MT(Ith) ?
166
DE-ACTIVATE IGNITION PROVING CIRCUIT
YES
160
IS LOW STAGE INPUT ON?
NO
162
SHUT DOWN AND WAIT FOR LOW STAGE INPUT TO TURN ON
132
IS MOTOR TORQUE MT <MT(hth) ?
134
DE-ENERGIZE HIGH STAGE GAS VALVE
C

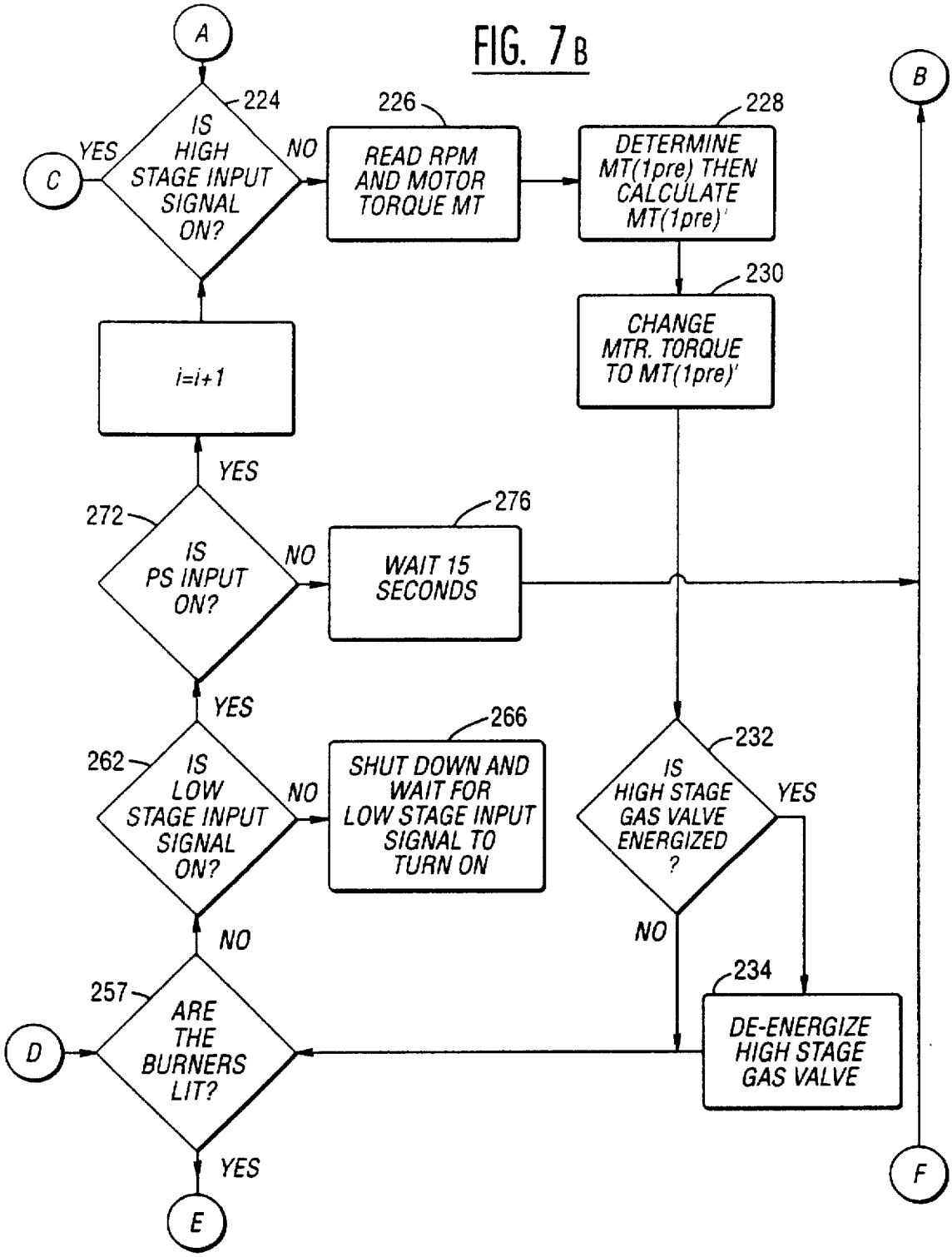
FIG. 7B
A
B
C
D
E
F
224
IS HIGH STAGE INPUT SIGNAL ON?
YES
NO
226
READ RPM AND MOTOR TORQUE MT
228
DETERMINE MT(1pre) THEN CALCULATE MT(1pre)'
230
CHANGE MTR. TORQUE TO MT(1pre)'
i=i+1
YES
272
IS PS INPUT ON?
NO
276
WAIT 15 SECONDS
YES
262
IS LOW STAGE INPUT SIGNAL ON?
NO
266
SHUT DOWN AND WAIT FOR LOW STAGE INPUT SIGNAL TO TURN ON
232
IS HIGH STAGE GAS VALVE ENERGIZED ?
YES
NO
NO
257
ARE THE BURNERS LIT?
234
DE-ENERGIZE HIGH STAGE GAS VALVE
YES E
F
G
H
IS HIGH STAGE INPUT SIGNAL ON?
YES
NO
READ RPM AND MOTOR TORQUE MT
258
DETERMINE MT(1pre) THEN CALCULATE MT(1pre)'
259
CHANGE MTR. TORQUE TO MT(1pre)'
i=i+1
YES
274
IS PS INPUT ON?
NO
278
WAIT 15 SECONDS
YES
264
IS LOW STAGE INPUT SIGNAL ON?
NO
268
SHUT DOWN AND WAIT FOR LOW STAGE INPUT SIGNAL TO TURN ON
IS HIGH STAGE GAS VALVE ENERGIZED ?
YES
NO
DE-ENERGIZE HIGH STAGE GAS VALVE

VARIABLE SPEED INDUCER MOTOR CONTROL METHOD

BACKGROUND OF THE INVENTION

1. Field of the Invention

This invention relates generally to gas furnaces and more particularly to the operation of a smart inducer motor so as to provide constant combustion air and/or combustion products flow regardless of various conditions both external to and internal to an induced-draft gas furnace.

2. Description of Background

In the operation of an induced-draft gas-fired furnace, combustion efficiency can be optimized by maintaining the proper ratio of the gas input rate and the combustion air flow rate. Generally, the ideal ratio is offset somewhat for safety purposes by providing for slightly more combustion air (i.e., excess air) than that required for optimum combustion efficiency conditions. In order that furnace heat losses are minimized, it is important that this excess air level is controlled.

In practice, the rate of combustion excess air flow is affected by a number of factors including vent length, furnace size, and wind conditions. Although furnace size may be predetermined at the factory, vent length is commonly not known until actual installation time, and wind conditions are normally highly variable during operation of the furnace. Additional conditions such as partial blockages by debris of various kinds can also affect combustion excess air flow rate while the furnace is in operation.

In addition, a large number of different furnace models are commonly in use at present, and it is highly desirable to provide a method which can be adapted to both a variety of different furnace models currently in use, as well as those that may be manufactured in the future. More specifically, it is desired to have a method of providing excess air control in both two stage and single stage products, as well as in both condensing and non-condensing furnaces.

Finally, different benefits may be derived from using the method of this invention depending upon the nature of the furnace in which it is used. Such benefits include the possibility of increased efficiency, lower operating cost, a higher degree of flexibility as to mode of installation, and less noise.

SUMMARY OF THE INVENTION

According to its major aspects and broadly stated, the present invention relates to an improved method for controlling excess air in a fixed gas input rate induced draft furnace having a heat exchanger and an inducer motor controlled by a microprocessor.

In the method of the invention, torque values for controlling the speed of the inducer motor are determined from a lookup table wherein current motor speed is correlated with torque necessary to achieve a theoretically desired inducer motor speed and furnace excess air level associated with a selected operating state. The method may be implemented in a single stage furnace or in a two stage furnace wherein torque values necessary for both low and high stage operating conditions are stored in the lookup table. In a single stage furnace, the lookup table will include a combustion operating plot which correlates current motor speed with torque necessary to achieve a theoretically desired inducer motor speed and furnace excess air level associated with a combustion operating state. In a two stage furnace, a lookup table of the invention will include a low stage plot and a high stage plot. The low stage plot correlates current motor speed with torque required to achieve desired furnace excess air level in a low stage operating state, and the high stage plot correlates current motor speed with torque required to achieve a desired furnace excess air level in a high stage operating state.

The lookup table may be established by recording data from a test furnace operating under ideal laboratory conditions. In one embodiment, theoretically desired motor speeds and torques for various operating states in a range of vent conditions may be established by measuring flue gas carbon monoxide concentration from the furnace while the furnace is changed from operating state to operating state.

Whatever the current motor speed, an appropriate torque value required for achieving a selected operating state may be determined from the lookup table. The lookup table thus enables efficient operation of the furnace during periods of changing flow restrictions. If, for example, a gust of wind decreases the load on the inducer motor causing an increase in motor speed, a new torque commensurate with the changed speed is automatically determined from the lookup table.

The present invention may be implemented as a dedicated system for controlling a specific furnace type, or may be implemented as an adaptive system which adapts its performance according to which of several candidate furnace types the system controls.

In a dedicated system for controlling a single stage furnace, a lookup table according to the invention preferably comprises two plots. In addition to a combustion operating plot for maintaining a desired furnace excess air level under combustion operating conditions, the lookup table of a dedicated system in a single stage furnace includes a combustion threshold plot. The combustion threshold plot correlates current motor speed with torque required for achieving a minimally satisfactory excess air level under combustion operating conditions. If the current torque falls below the combustion threshold torque of the lookup table, the ignition proving circuit of the furnace is deactivated.

In a dedicated system for controlling a two stage furnace, a lookup table according to the invention preferably comprises four plots. In addition to a low stage plot for achieving a desired furnace excess air level in low stage, and a high stage plot for achieving a desired furnace excess air level in high stage, the lookup table includes a low stage threshold plot and a high stage threshold plot. The low stage threshold plot correlates current motor speed with torque necessary to achieve a minimally satisfactory excess air level under low stage operating conditions. If motor torque falls below the torque of the low stage threshold plot, then the ignition proving circuit of the furnace is deactivated. The high stage threshold plot correlates current motor speed with torque required for achieving a minimally satisfactory excess air level under high stage conditions. The high stage gas valve of a two stage furnace is energized only if the current motor torque exceeds the torque value for the high stage threshold plot of the lookup table.

In an adaptive system for controlling excess air level, a furnace according to the invention includes a pressure switch that is selected to open at a predetermined pressure (and excess air level) at or above a minimally satisfactory excess air level. The pressure at which the switch opens is selected based on pressure drop across the heat exchangers that is commensurate with a minimum satisfactory excess air level under low stage operating condition.

The lookup table in an adaptive system for controlling furnace excess air level is constructed by averaging low stage, high stage and high stage threshold plots for each of several differently-sized furnaces. An adaptive system lookup table further includes a reference plot. The reference plot in an adaptive system lookup table is formed by averaging postulated reference plots for each of several differently-sized furnaces. Each postulated reference plot plots the torque and motor speed associated with the switch closing pressure rating of the pressure switch selected for the furnace. When during operation the pressure switch of a furnace closes, the motor torque at the time of switch closing is compared to the torque from the adaptive system lookup table, to determine DELTA, a torque biasing value. The torque biasing value DELTA is added to all subsequent torques determined from the lookup table so that torque values applied to the inducer motor of a furnace are biased according to furnace size and pressure switch calibration variations.

A major feature of the present invention is the providing of a lookup table that correlates current motor speed with torque values necessary for achieving desired inducer motor speeds and excess air levels at selected operating states. Providing a lookup table for controlling applied inducer motor torque results in an improved method for controlling furnace excess air levels in which applied motor torque adapts to changes in ventilation conditions.

Another and more particular feature of the present invention is the inclusion in the lookup table of a threshold plot commensurate with minimally acceptable motor speeds under combustion operating conditions, or under low stage combustion operating conditions in the case of a two stage furnace. The reference torque value ensures that the furnace will operate at a speed above that producing a minimally satisfactory excess air level.

Yet another feature of the invention is the inclusion in the lookup table of threshold torque values commensurate with minimally acceptable motor speeds under high stage condition in the case of a two stage furnace. Inclusion of high stage threshold torque values facilitates proper energizing of the high stage gas valve, and thereby eliminates the need for a high pressure switch in the furnace.

Still another important feature of the invention is the provision for a pressure switch selected to close at a pressure at or above a pressure commensurate with a minimally satisfactory excess air level. Inclusion of a pressure switch provides an adaptive furnace control system in which performance of the system is adaptive depending on the type and size of furnace being controlled.

These and other important features of the present invention will become apparent to those skilled in the art from a close reading of the Detailed Description of the Invention in conjunction with referenced Drawings.

BRIEF DESCRIPTION OF THE DRAWINGS

For a better understanding of these and other objects of the present invention, reference is made to the detailed description of the invention which is to be read in conjunction with the following drawings, wherein:

FIG. 7*a*–7*e* comprise a flow chart illustrating operation of an adaptive control method according to the invention.

DETAILED DESCRIPTION OF THE INVENTION

The instant invention may be applied generally to single or two stage induced draft gas furnaces. Depending upon the type of furnace involved, different advantages are obtainable, as will be discussed hereinafter. However, for a better understanding of its operation, its use in conjunction with a two-stage condensing furnace is described. U.S. Pat. No. 4,729,207 to Dempsey et al. assigned to a common assignee, teaches a method of air flow regulation for an Electronically Commutated Motor (ECM). U.S. Pat. No. 5,331,944 to Kujawa et al. also assigned to a common assignee, teaches a method of air flow regulation for an Integrated Control Motor (ICM). The teachings of the 4,729,207 patent and the 5,331,944 patent are herein incorporated by reference as these teachings relate to the present invention which, like the 5,331,944 patent, applies to an Integrated Control Motor (ICM). The ICM has electronics built into the motor and is controlled by the software therein, and is thus a "smart" inducer motor, while the ECM was a two-piece design controlled by electronic hardware.

Figure 1:
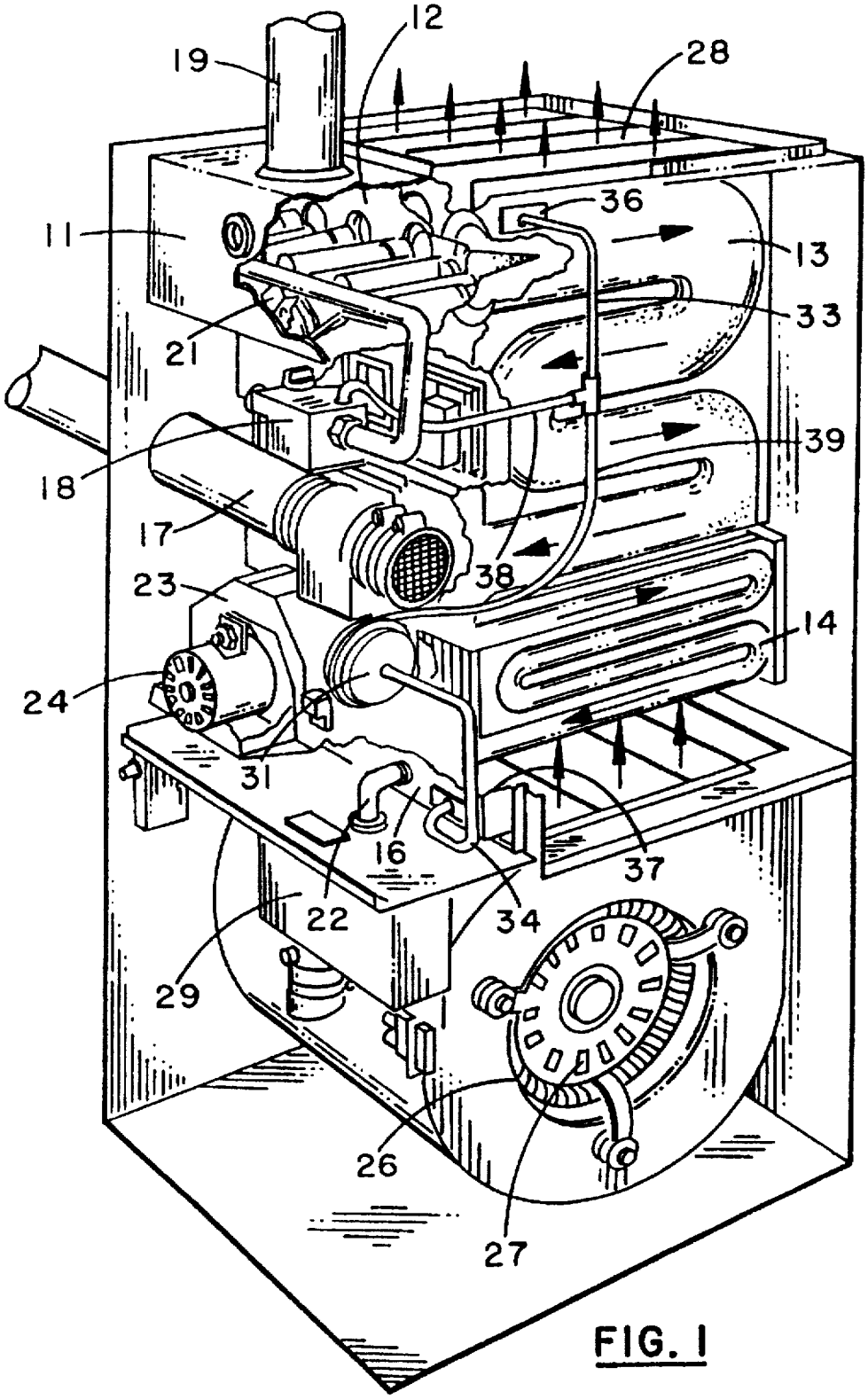
FIG. 1 is a perspective view of a gas furnace having a pressure switch according to the present invention incorporated therein.

Referring now to FIG. 1, there is shown a furnace of one of the general types with which the present invention can be employed, namely a two-stage condensing furnace. A burner assembly 11 communicates with a burner box 12 to a primary heat exchanger 13. Fluidly connected at the other end of the primary heat exchanger 13 is a condensing heat exchanger 14 whose discharge end is fluidly connected to a collector box 16 and an exhaust vent 17. In operation, gas valve 18 meters the flow of gas to the burner assembly 11 where combustion air from the air inlet 19 is mixed and ignited by igniter assembly 21. The hot gas is then passed through the primary heat exchanger 13 and the condensing heat exchanger 14, as shown by the arrows. The relatively cool exhaust gases then pass through the collector box 16 and the exhaust vent 17 to be vented to the atmosphere, while the condensate flows from the collector box 16 through a condensate drain line 22 from where it is suitably drained to a sewer collection or the like. Flow of the combustion air into the air inlet 19 through the heat exchangers 13 and 14, and the exhaust vent 17, is enhanced by a draft induced blower 23 which is driven by an ICM inducer motor 24 in response to control signals from the furnace control and pressure switch 31 contained therein.

The household air is drawn into a blower 26 which is driven by a drive motor 27, in response to signals received from either its own internal microprocessor, or the furnace control contained in the furnace control assembly 29, or a combination of both. The discharge air from the blower 26 passes over the condensing heat exchanger 14 and the primary heat exchanger 13, in counterflow relationship with the hot combustion gases, to thereby heat up the household air, which then flows from the discharge opening 28 to the duct system within the home.

Figure 2:
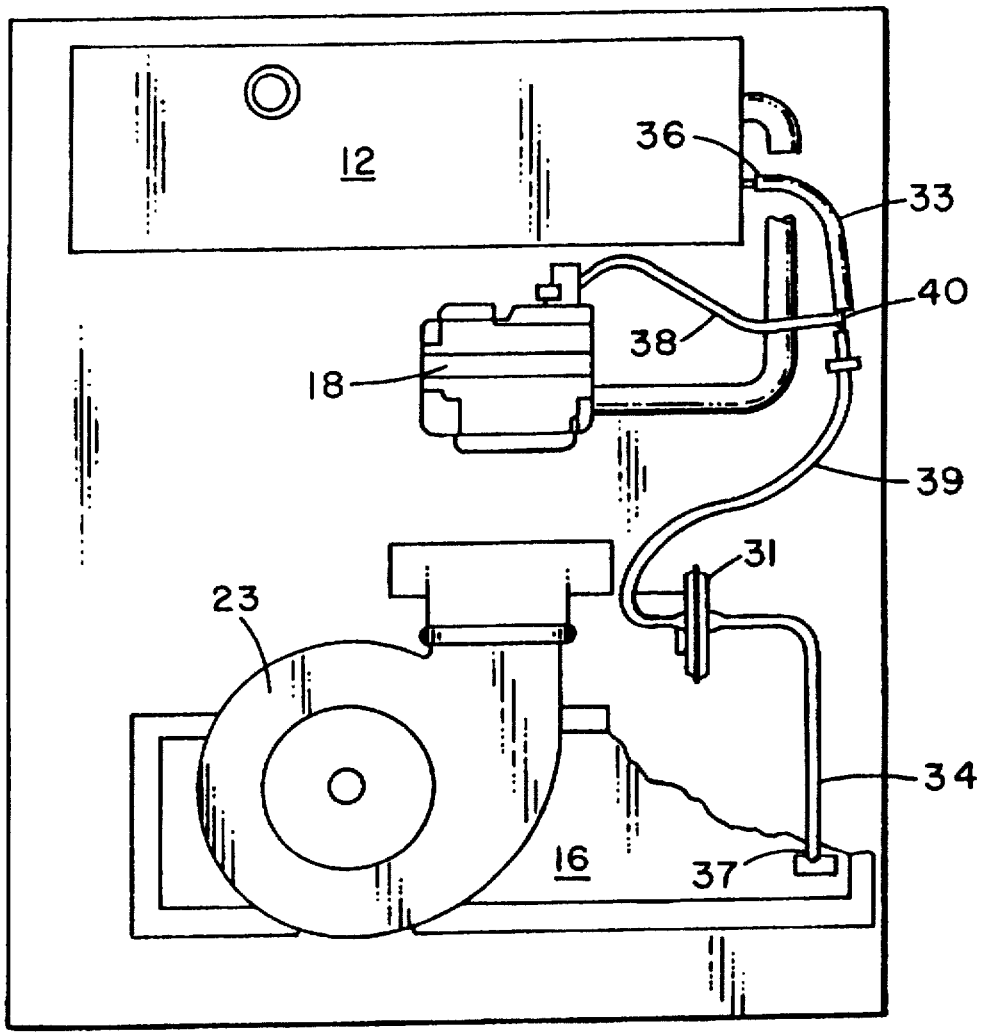
FIG. 2 is a schematic illustration of the installed pressure switch thereof as applied to the heat exchanger system.

In certain embodiments of the present invention, in particular in embodiments having adaptive furnace control systems, a pressure switch 31 may be fluidly connected to burner box 12 so as to permit the measurement of the pressure drop across the heat exchanger system. Switch 31 is mechanically connected within the system to sense the exchanger pressure drop as shown in FIG. 2.

Specifically, a burner box tube 33 leads from the pressure tap 36 and the collector box tube 34 leads from the pressure tap 37, and switch 31 is fluidly connected therebetween. Switch 31 is calibrated to break, or open, at a specific pressure differential. A switch that has been found satisfactory for use in this manner is commercially available from Tridelta as part number FS 6002-249.

Since the system normally operates under negative pressure conditions, it is necessary to fluidly connect the vent of gas valve 18 with the tube 38 to tubes 33 and 39 via a "T" fitting 40 so as to reference low pressure switch 31, and gas valve 18 to the negative pressure in burner box 12 while ICM inducer motor 24 is in operation.

The ICM microprocessor mentioned hereinabove is contained as part of the ICM inducer motor 24. In response to electrical signals from inducer motor 24, and possibly from other signals to be discussed hereinafter, the ICM microprocessor operates to control the ICM inducer motor 24 while the blower motor 27 is controlled as described above, operating together in such a way as to promote an efficient combustion process at different gas input rates. The ignition proving circuit discussed hereinafter, is typically located as an integral part of furnace control 29. The ignition proving circuit energizes igniter assembly 21 after pressure switch 31 makes in an adaptive inducer control strategy, or the ICM inducer motor 24 activates the ignition proving circuit in a dedicated inducer control strategy. The ignition circuit proving is usually comprised of two relays and a flame sense circuit. One relay energizes igniter assembly 21 and the other relay turns on gas valve 18 after igniter assembly 21 heats up. The flame sense circuitry simply verifies ignition occurred and de-energizes gas valve 18 if it hasn't.

In the present invention, the ICM microprocessor controls the speed of motor 24 by determining torques from a lookup table pre-programmed within the ICM microprocessor system.

Figure 3:
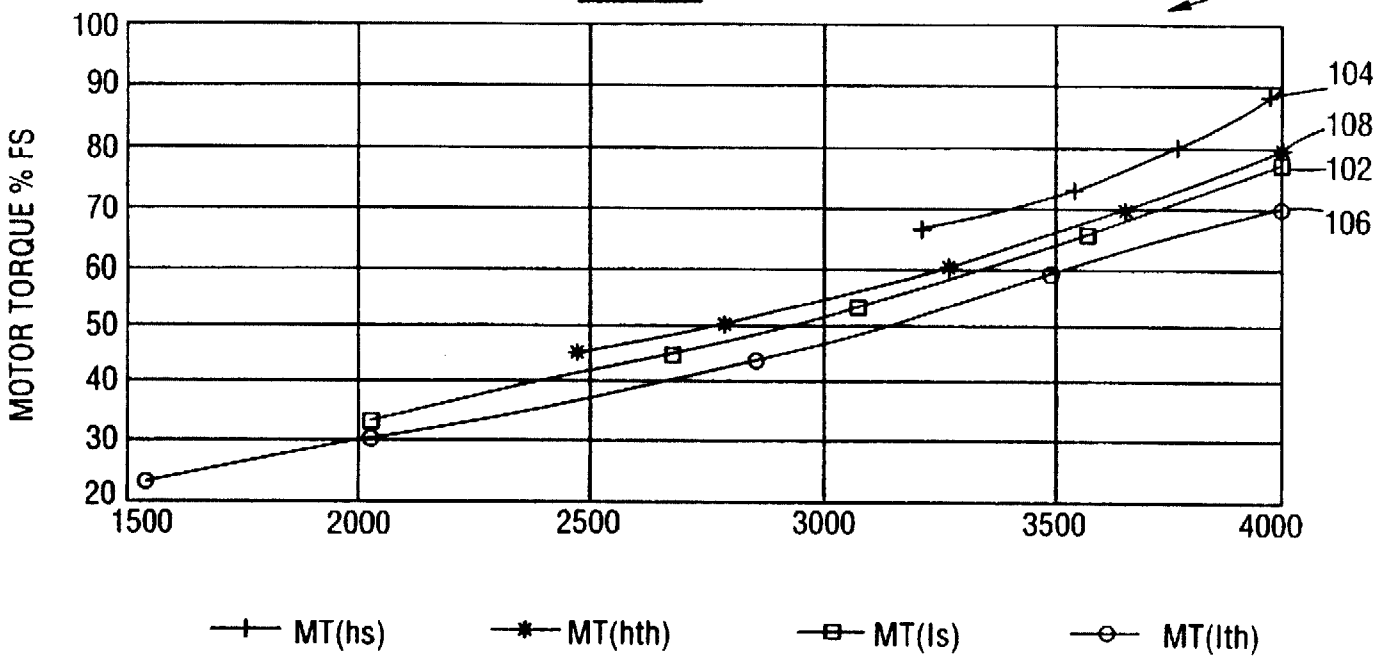
FIG. 3 shows a graphical representation of a typical lookup table in a dedicated method according to the invention which is used to select motor torques.

A dedicated system lookup table according to the invention that corresponds to a particular furnace type, specifically a model 58 MVP 5 cell 2 stage furnace of the type manufactured by Carrier Corp. of Indianapolis, Ind. is shown in FIG. 3. Lookup table 100 correlates current motor speed with torque required to achieve various operating states. For example, if current motor speed is 3500 RPM, then a desired low stage excess air level can be achieved by applying torque to the motor of about 64% (FS) full scale. A desired high stage excess air level can be achieved by applying an initial torque of about 73% FS to inducer motor 24.

In addition to low stage and high stage plots 102 and 104 correlating motor speed with torque values required for attaining desired low and high stage operating conditions, respectively, lookup table 100 also includes a low stage threshold plot 106 and high stage threshold plot 108.

Low stage threshold plot 106 correlates current motor speed with torque required to achieve a minimally satisfactory excess air level under low stage operating conditions. If motor torque falls below the torque of the low stage threshold plot, then the ignition circuit of the furnace is deactivated by the ICM inducer motor. High stage threshold plot 108 correlates current motor speed with torque required for achieving a minimally satisfactory excess air level under high stage conditions. The high stage gas valve of a two stage furnace is energized by the ICM inducer motor only if the current motor torque exceeds the torque value for the high stage threshold plot of the lookup table.

Lookup table 100 shown in FIG. 3 was developed by manually operating a variable speed inducer motor in a two-stage furnace at a range of flow restrictions in the laboratory.

For establishing lookup table 100, a laboratory inducer motor is provided which can be set to various torque levels in 1% or less increments and provides an RPM output pulse signal of two pulses per revolution. Lookup table 100 is established by recording motor torque and RPM from a test furnace operating under ideal laboratory conditions. These theoretically desired motor speeds and torques are determined at a variety of states in a range of flow restrictions and are established by measuring and controlling flue gas carbon monoxide concentrations from the furnace below recognized industry limits while the furnace is operating in low stage and high stage. In addition, other criteria can be established which provides additional combustion excess air flow above that needed to meet the emission requirements. Such criteria could involve increasing the combustion excess air flow to reduce heat exchanger hot spot temperatures or to reduce the percent $CO_2$ in combustion products to allow lower minimum heat exchanger temperatures.

For the flow chart of FIG. 3, low stage threshold plot 106 and high stage threshold plot 108 are based on torques and motor speeds resulting in a flue gas CO concentration of less than 200 parts per million (PPM) air free at normal low and high stage gas input rates, while low stage operating plot 102 and high stage plot 104 correspond to torques and motor speeds resulting in a flue gas CO concentration of less than 400 PPM air-free at a rate 15% above normal low & high stage gas input rates.

Now referring to FIGS. 4*a* through 4*c*, operation of an ICM inducer motor in a two stage furnace controlled by a dedicated system lookup table like that shown in FIG. 3 will be described in detail.

Figure 4A:
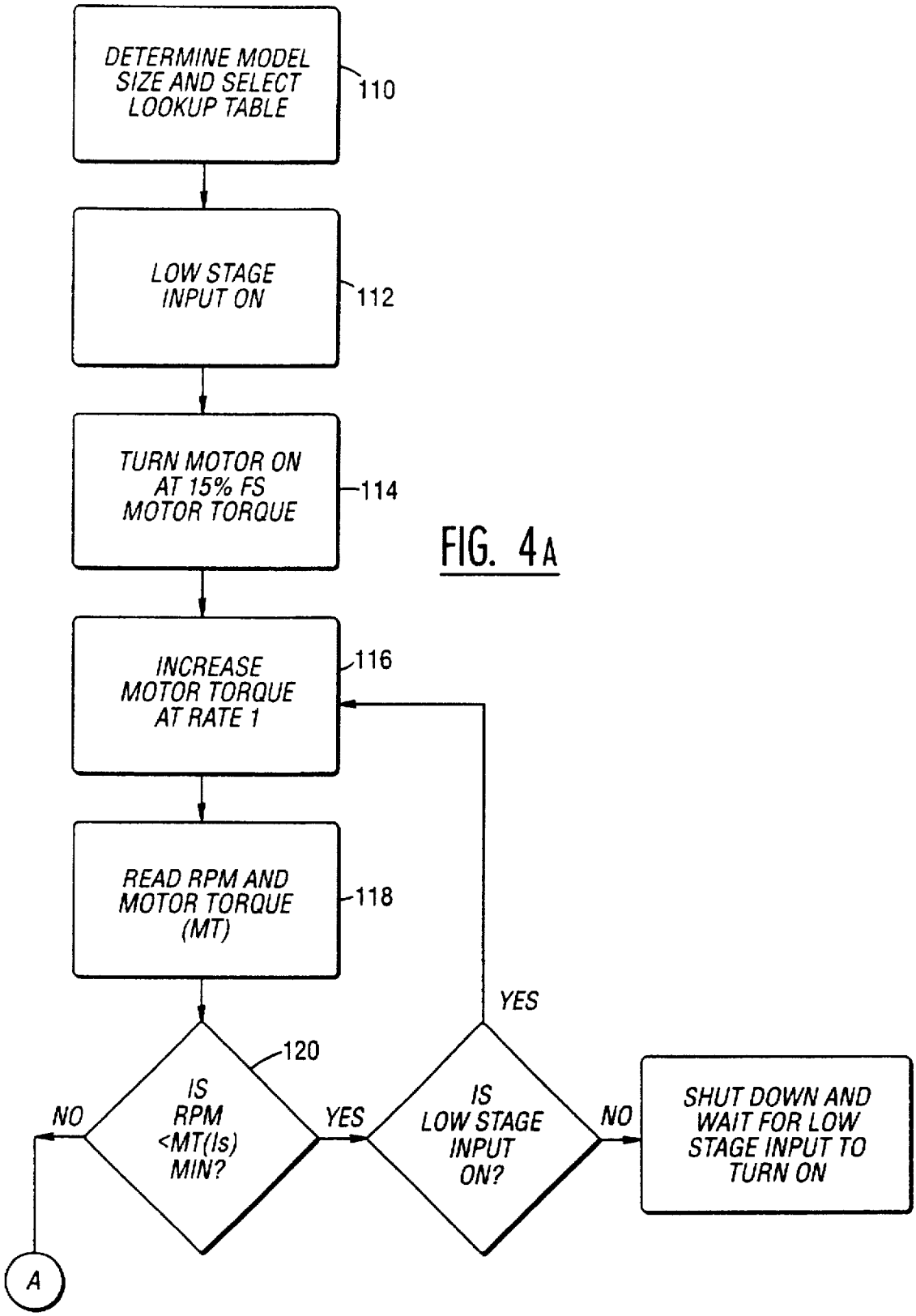
FIGS. 4*a*–4*c* comprise a flow chart illustrating the operation of a dedicated method according to the invention.

As indicated in FIG. 4*a* at 110 a preliminary step in the operation of a dedicated control method according to the invention is the selection of an appropriate lookup table for the furnace used. Typically, the ICM inducer system of the furnace will have stored therein several candidate lookup tables, each corresponding to a different furnace type. Selection of an appropriate lookup table may be made by activation of a manual switch in a manual switch array, through a serial interface to the furnace microprocessor system or from a model select plug on the ICM inducer motor.

Selection of an appropriate lookup table may also be made automatically in response to signals from a sensor or sensors which sense the type and/or size of furnace being used. A sensor that senses the type and/or size of the furnace used may be provided by using a flow sensor to sense input rate to the furnace.

Once a lookup table is selected, a call for heat is signalled by the low stage input signal turning on or activating, commonly as a signal from the furnace control board, at step 112. The system responds by having the ICM inducer motor 24, which has been idle, immediately step up to a rate of about 15% FS motor torque, in step 114 and then accelerate at RATE1, which is 2% FS motor torque/sec. in step 116.

At step 120, a determination is made as to whether the current speed, read in step 118 of inducer motor 24 has exceeded a minimum low stage speed. The minimum low fire stage is the minimum speed which can generate a low stage operation of the particular furnace used, and is determined from lookup table 100. In a furnace associated with the lookup table of FIG. 3, minimum low stage motor speed is about 2100 RPM.

When current motor speed exceeds a minimum low stage motor speed, a determination is made, at step 124, as to whether an input signal for high stage has been made. If an input signal for high stage has not been made, then the furnace control system operates according to the flow diagram section of FIG. 4b.

In low stage operation, current motor speed and torque are read at step 126 and then, at step 128, MT(ls), MT(lth), and MT(hth) are determined from lookup table 100 according to the current motor speed reading. MT(ls) from plot 102 is the torque required to achieve a desired excess air level in low stage operating conditions, MT(lth) from plot 106 is the torque required for achieving a minimally satisfactory motor speed and excess air level in low stage operating conditions, and MT(hth) from plot 108 is a torque value required for achieving a minimally satisfactory motor speed and excess air level in high stage operating conditions.

At step 130, the torque applied to motor 24, is changed to MT(ls), the torque required for achieving a desired excess air level in low stage operating conditions. Thus, during low stage operation, the torque applied to inducer motor 24 will be determined from low stage plot 102 of lookup table 100.

Low stage operation of a furnace controlled according to the method of the invention is best described by way of example. When starting from a shutdown operating state, the initial low stage motor torque, MT(ls) (1) will be the low stage torque corresponding to a speed just above minimum low stage speed, the branch condition speed of step 120. With reference to lookup table 100, the initial low stage operating torque is the torque corresponding to a motor speed of about 2100 RPM. In lookup table 100 the initial low stage operating torque from the MT(1s) plot that corresponds to a motor speed of 2100 RPM is 33% FS motor torque. Therefore, the minimum torque from the MT(1s) plot of 33% FS is applied to motor 24 as the initial low stage motor torque, MT(1s) (1). Because the initial low stage motor torque will be different than the actual applied motor torque motor speed will change. For example, if motor speed is initially 2100 RPM then motor speed may increase to a speed of 2400 RPM upon application of the initial low stage motor torque MT(1s) (1) of 33% FS. The subsequent low stage motor torque, MT(1s)(2), is the torque from low stage plot 102 that corresponds to a motor speed of 2400 RPM. From the lookup table of FIG. 3, the second low stage motor torque will be about 40% FS. Motor speed will again increase as a result of the increased torque, and the next low stage torque, MT(1s) (3) will be greater than 40% FS. However, for each iteration, the increase in motor speed resulting from an increase in torque will be less than the motor speed increase of the previous iteration. Eventually, a stable point on low stage plot 102 will be reached wherein, barring changes in flow restrictions, the low stage torque, MT(1s) (n) determined from the lookup table is essentially the same as the previously-determined low stage torque from lookup table 100, MT(1s) (n−1).

The steady-state operating point attained on the lookup table can change if there are changes resulting from wind gusts, debris clogging combustion air and flue gas passages, or manual adjustment of venting. If, for example, a change in flow restriction decreases the loading of the inducer motor, then the speed of the motor will increase, and a new torque value will be automatically determined from the lookup table. In this way, the excess air control method of the present invention automatically compensates for changes in flow restriction.

Figure 4B:
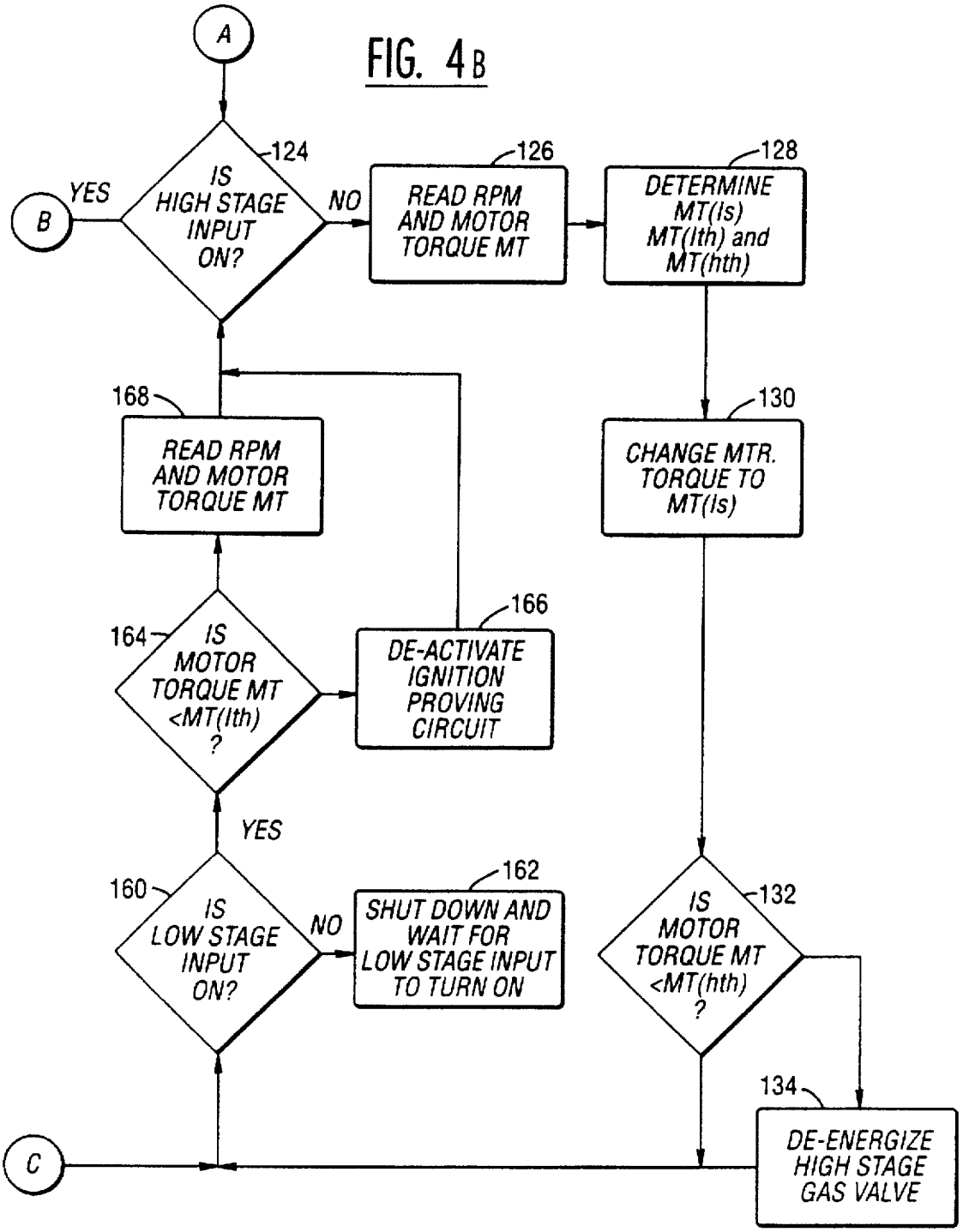

Referring again to the flow diagram segment of FIG. 4b, step 132 determines if current motor torque read in step 126 is less than MT(hth), the motor torque read from high stage threshold plot 108. Current motor torque read in step 126 will normally be less than MT(hth) and program control will proceed directly to step 160 after execution of step 132. However, if the furnace was in a high stage operating state immediately prior to executing step 132, and the current motor torque read in step 126 is less than MT(hth), then step 134 is executed to de-energize the high stage solenoid in gas valve 18. It is seen from FIG. 4b that the ignition circuit of the furnace will be activated at step 168 after the initial low stage motor torque is applied, if the current motor torque read in step 126 is greater than MT(lth) determined in step 128.

As mentioned, a determination as to whether an input signal for high stage has been received in step 124. When an input signal for high stage is received, the microprocessor reads motor speed and torque in step 140, and then ramps up torque in step 142 until the microprocessor determines in step 144 that a minimum motor speed is achieved. The minimum motor speed will be the minimum speed from the high stage plot 104 of the particular lookup table used. In the lookup table of FIG. 3, this speed will be about 3200 RPM.

Once the microprocessor determines that a minimum speed is achieved, at step 144, the microprocessor at step 146 reads MT(hth) as described previously, and MT(hs), a torque required to achieve a desired high stage operating speed. The microprocessor controls the torque applied to the inducer motor in accordance with MT(hs) at step 148 to maintain a constant flow of combustion air through the furnace. The initial high stage torque, MT(hs)(1) will be less than the torque required to reach a steady state high stage motor speed. When an input signal for high stage is first received by the microprocessor at step 124, the motor speed read in step 140 will normally be at a torque corresponding to a low stage operating condition. After the minimum high stage motor speed is achieved in step 144 the initial high stage torque will be determined according to plot 104 in lookup table 100. Thus, the inducer motor speed will increase after application of the first high stage motor torque MT(hs)(1). Thus, the next, and subsequent high stage torques applied to the inducer motor, MT(hs) (2), MT(hs) (3), MT(hs) (n) will be greater than the previous high stage torque applied to the motor until a fixed point is reached on a high stage plot 104 from the lookup table wherein the present torque commensurate with the present speed of the motor is equivalent to the previously applied torque MT(hs) (n−1).

As in the case of low stage operation, the fixed point attained on the lookup table can change if there are changes in flow restriction resulting from wind gusts, debris clogging combustion air and flue gas passages or manual adjustment of venting.

Figure 4C:
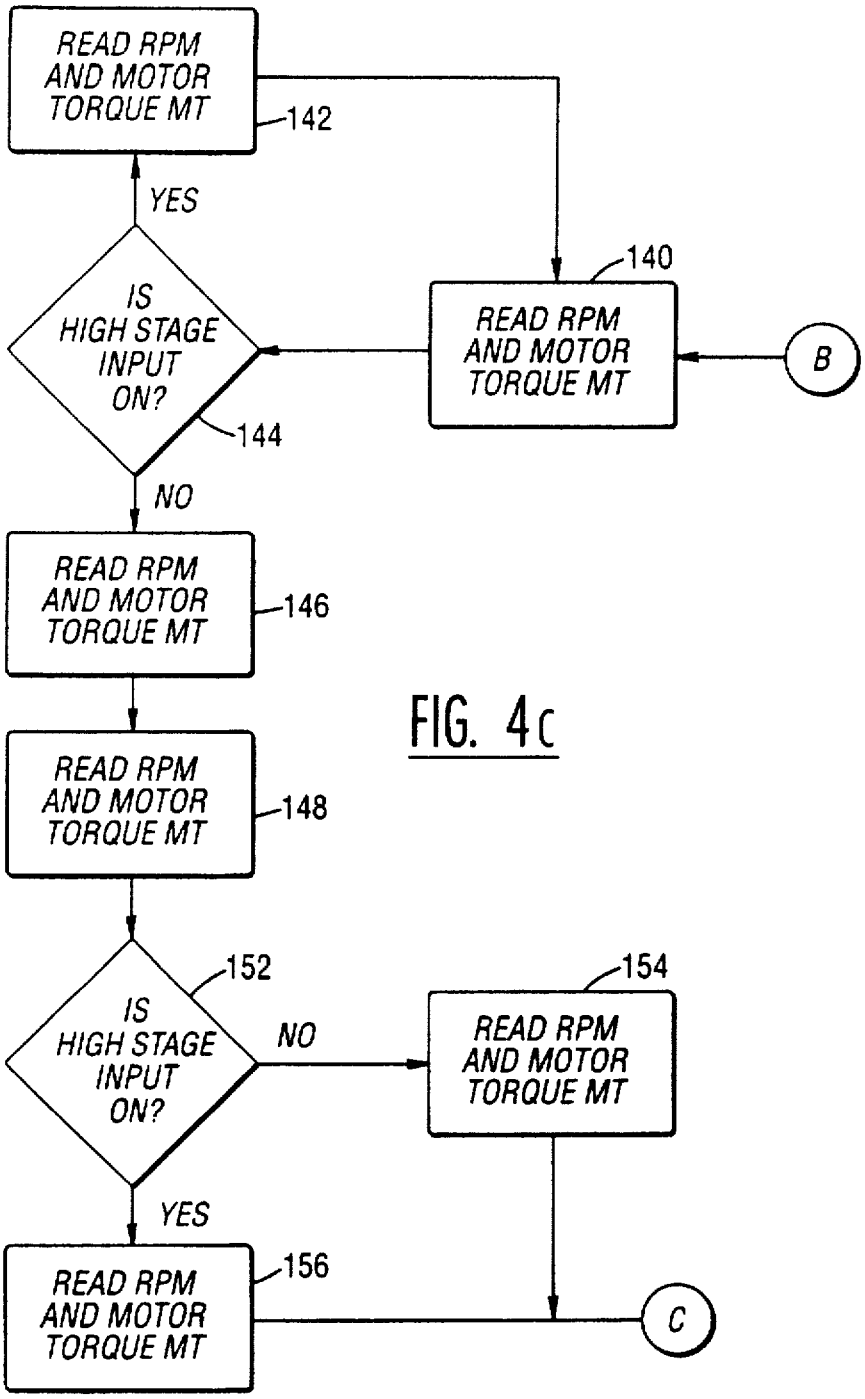

Returning to the flow diagram segment of FIG. 4c it is seen, according to step 152 that high stage gas valve 18 is not energized at step 154 until the current motor torque, MT, read at step 140 is greater than Mt(hth), the torque commensurate with a minimally satisfactory high stage combustion excess air level. Delaying energizing the high stage solenoid until the current motor torque is greater than Mt(hth) ensures that a proper combustion excess air level for high stage operation is obtained before high stage operation is commenced.

Step 160, executed during both low and high stage operation of the furnace determines if an input signal shutting down the inducer motor has been received. If the low stage input is not on, then the motor shuts down according to step 162, and program control shifts to step 112, wherein the microprocessor waits for a low stage input signal to be received.

Step 164, also executed during both high and low stage operation of the furnace determines if the current motor torque, MT, read in step 126 or in step 140 has fallen below the MT(lth), the torque required for achieving a minimally satisfactory excess air level under low stage operating conditions. A large sudden change in flow restriction may cause current motor torque to fall below minimally satisfactory motor torque MT(lth). If motor torque MT falls below minimally satisfactory motor torque MT(lth), then the ignition proving circuit of the furnace is deactivated at step 166. The ignition proving circuit is reactivated at step 168 when in a subsequent iteration, motor torque MT increases above MT(lth).

The control method described with reference to FIGS. 4*a* though 4*c* can be easily adapted for application in a single stage furnace. For use in a single stage furnace, high stage torque is considered the single stage operating torque and furnace control is essentially according to the flow diagram segment of FIG. 4*c*, except that steps 154 and 156 energize and de-energize the ignition circuit of the furnace and not the high stage solenoid of gas valve 18. The lookup table for use in a single stage furnace is identical to plot 104 and 108 of lookup table 100. These plots correlate current motor speed with torque required to achieve a desired excess air level for single-stage combustion operating conditions, and a combustion threshold plot correlating current motor speed with torque required for achieving a minimally satisfactory excess air level for single-stage combustion conditions.

In a single stage furnace, motor torque MT will be increased according to step 142 until motor speed exceeds the minimum high stage motor speed from the lookup table (step 144). Then, motor torque will be controlled according to the high fire operating torque, at step 148. After the motor torque read at step 140 exceeds the high stage threshold torque from the lookup table, determined at step 146 the ignition proving circuit of the furnace is activated.

Now referring to FIGS. 5 through 7*e* an adaptive method and system for controlling a furnace excess air level in which performance of the method varies depending on furnace size is described.

Figure 5:
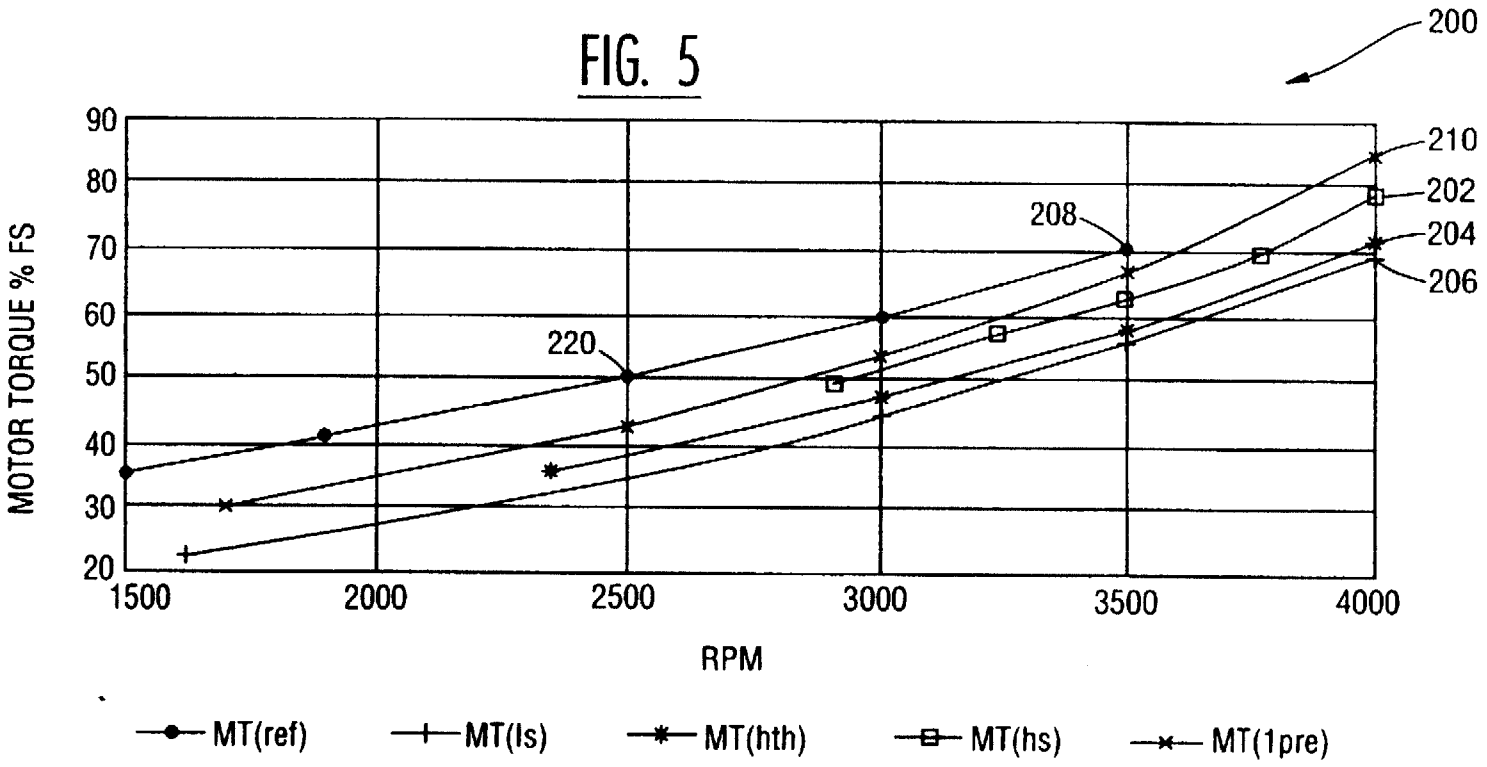
FIG. 5 shows a series of high stage RPM vs. Torque plots for use in constructing an adaptive-method lookup table.
Figure 6:
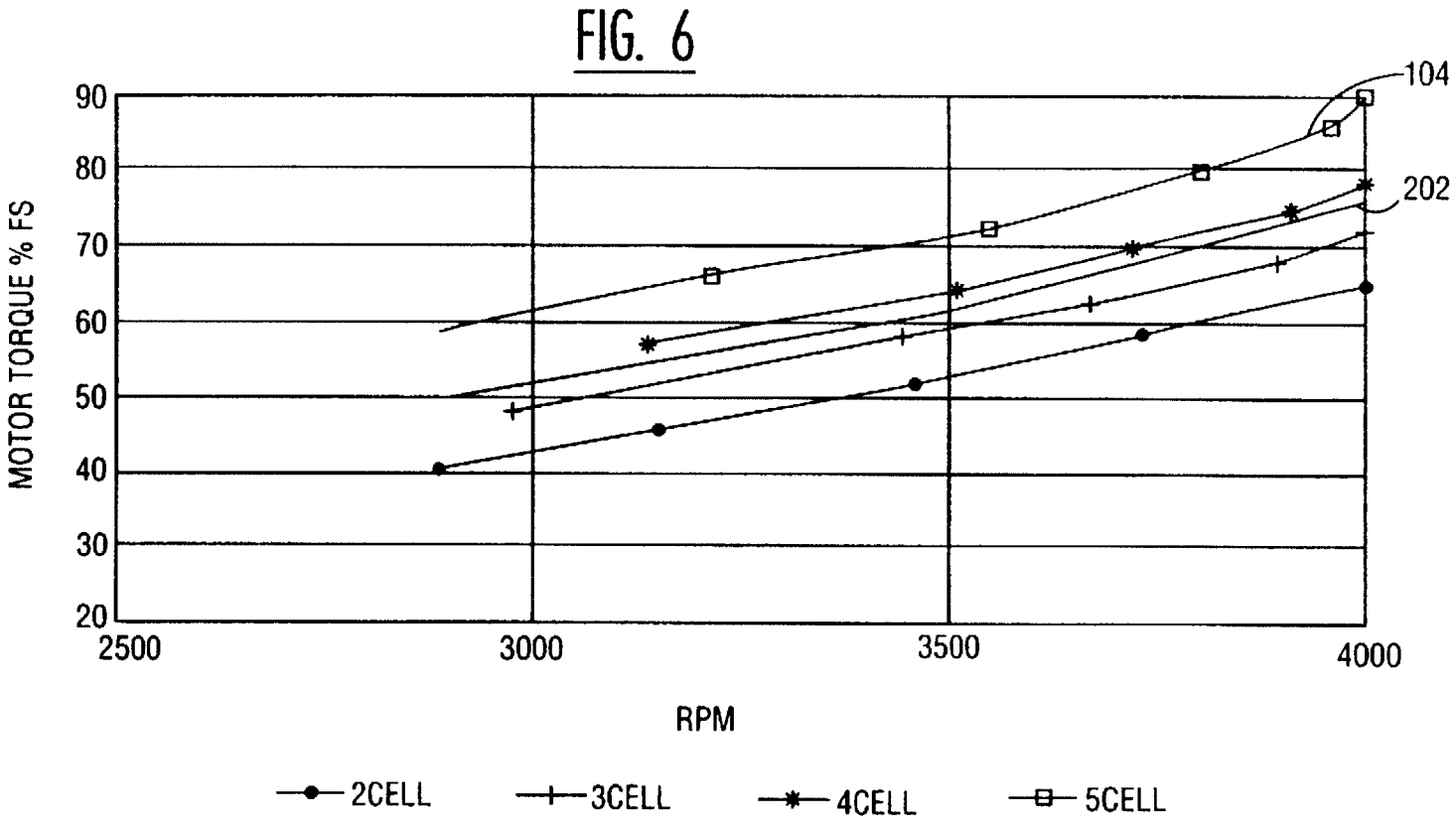
FIG. 6 shows a graphical representation a lookup table for use in an adaptive excess air level control method according to the invention.

A lookup table for an adaptive furnace excess air level control method is shown in FIG. 5. Lookup table 200 is created by averaging data from lookup table plots of several differently-sized furnaces. High stage threshold plots for lookup tables corresponding to several differently-sized furnaces are shown in FIG. 6. High stage threshold plot 104 corresponding to a 5 cell motor is the same plot used in the making of lookup table 100 described in connection with FIG. 3. The plot constructed by averaging the plots of the variously-sized furnaces is presented as bold plot 202. Bold plot 202 appears as high stage plot 202 in the adaptive-method lookup table of FIG. 5.

Like the lookup table for a dedicated method presented in FIG. 3, adaptive-method lookup table 200 includes a high stage plot 202, a high stage threshold plot 204, and a low stage plot 206, which perform substantially the same functions as in the dedicated method.

However, in the adaptive-method lookup table 200 the low stage threshold plot is deleted, and the lookup table includes additional plots, namely a reference plot 208 and a low stage pre-ignition plot 210. A low stage threshold plot is not required in an adaptive-method lookup table because pressure switch 31 wired in series with gas valve 18 is calibrated to open at a specific pressure differential commensurate with a minimally satisfactory combustion excess air level for low stage operation.

The furnace in an adaptive excess air level control method is modified to include a pressure switch 31 for sensing a pressure drop across heat exchanger 13 as described previously in connection with FIG. 1. Pressure switch 31 is selected to open, or break, at a pressure commensurate with an excess air level at or above an excess air level that is minimally satisfactory for low stage operation. It will be seen that reference plot 208 of adaptive lookup table 200 is provided to determine a torque biasing value, DELTA, and that pre-ignition plot 210 is provided to ensure that pressure switch 31 does not open before ignition of the furnace occurs.

Reference plot 208 of lookup table 200 is constructed after pressure switch 31 calibration is determined and a test pressure switch is calibrated to the nominal set point. Once pressure switch 31 is properly calibrated and installed within the furnace the inducer motor is started from rest and then the motor torque is gradually increased at RATE1, which is 2% FS motor torque/sec until pressure switch 31 makes. Under laboratory conditions this operation cannot be performed manually however, a programmable controller can be programmed to perform this function and capture motor speeds and torque's at a variety of states in a range of vent conditions at the exact instant pressure switch 31 makes. A programmable wave generator and a triggering oscilloscope can also be used instead of the programmable controller to perform the same function.

Pre-ignition plot 210 of lookup table 200 is constructed by manually operating a variable speed inducer motor in a two-stage furnace at various flow restrictions in the laboratory. Manual operation is performed the same as described previously in this application however, the theoretically desired motor speeds and torque's are determined at a variety of states in a range of vent conditions and are established by measuring and controlling to a constant heat exchanger differential pressure that is commensurate with the heat exchanger differential pressure observed while developing the low stage plot 206. Therefore, it is necessary to develop the low stage plot 206 first and note the heat exchanger differential pressure before plot 200 can be developed. In addition this heat exchanger differential pressure does not have to be the same as that observed while developing low stage plot 206 but it can be adjusted to a lower or higher heat exchangers differential pressure to reduce ignition noise or improve ignition characteristics respectively.

It is noted from adaptive-method lookup table 200 that the torque corresponding to MT(ref) 208, the reference torque, is more than MT(1pre) 210, the pre-ignition torque. This results from the dynamic effects associated with increasing the motor torque at RATE1 until pressure switch 31 makes. If the motor's rate of acceleration is reduced enough MT(ref) 208 and MT(1pre) 210 will have the same torque. If the motor's rate of acceleration is further reduced the torque corresponding to MT (ref) 208, the reference torque, will be less than MT(1pre) 210, the pre-ignition torque.

Control of a two-stage furnace according to an adaptive method of the invention is described in connection with the flow diagram of FIGS. 7*a*–7*e*. Note generally that unlike the case of a dedicated method, there is a pre-ignition low stage of operation as indicated by the flow diagram segment of FIG. 7*b*, and a pre-ignition high stage of operation as indicated by the flow diagram segment of FIG. 7*c*. Pre-ignition control of the furnace is required so as to avoid undesired opening of pressure switch 31 before ignition of the furnace.

Figure 7A:
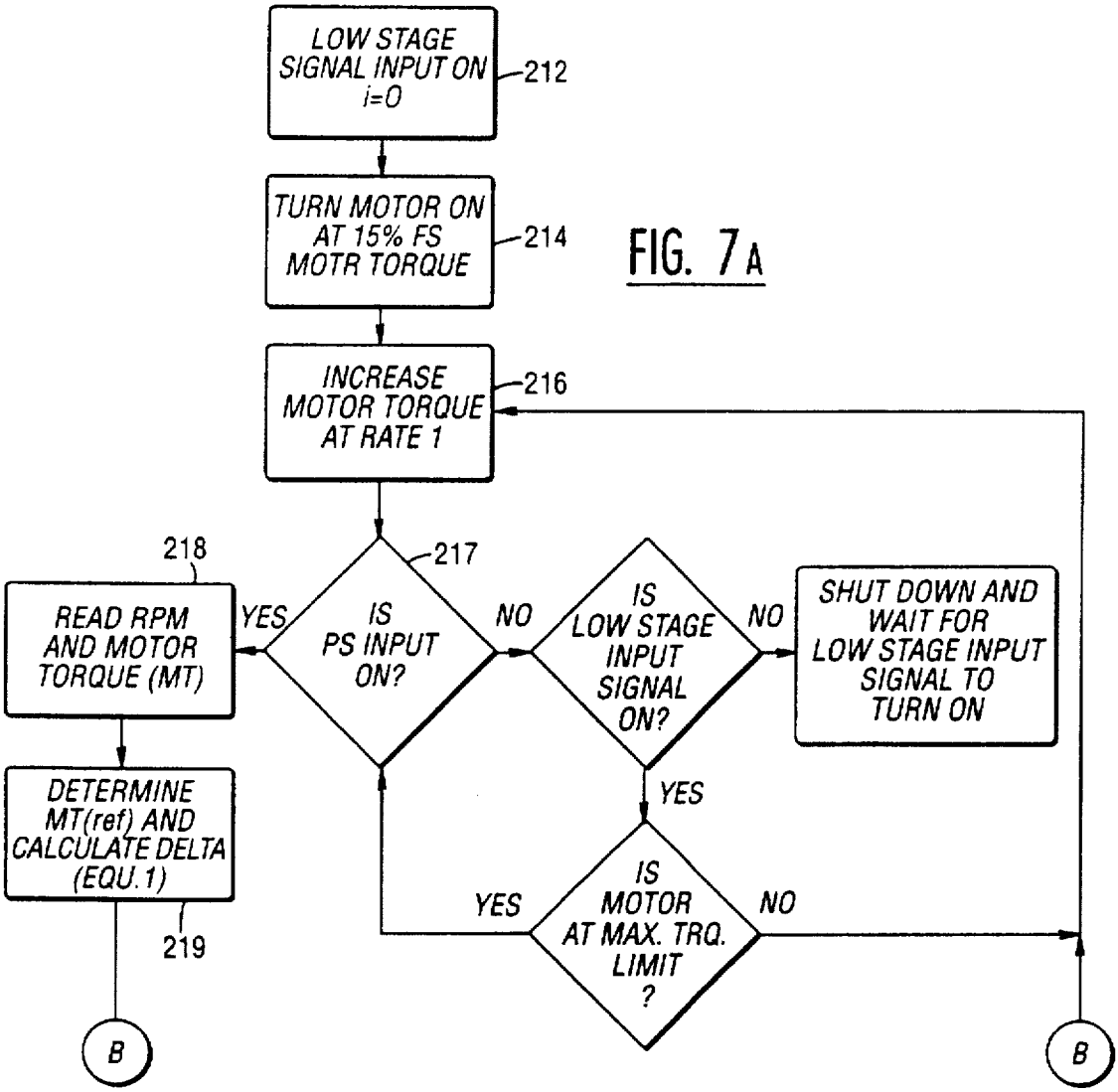
Figure 7C:
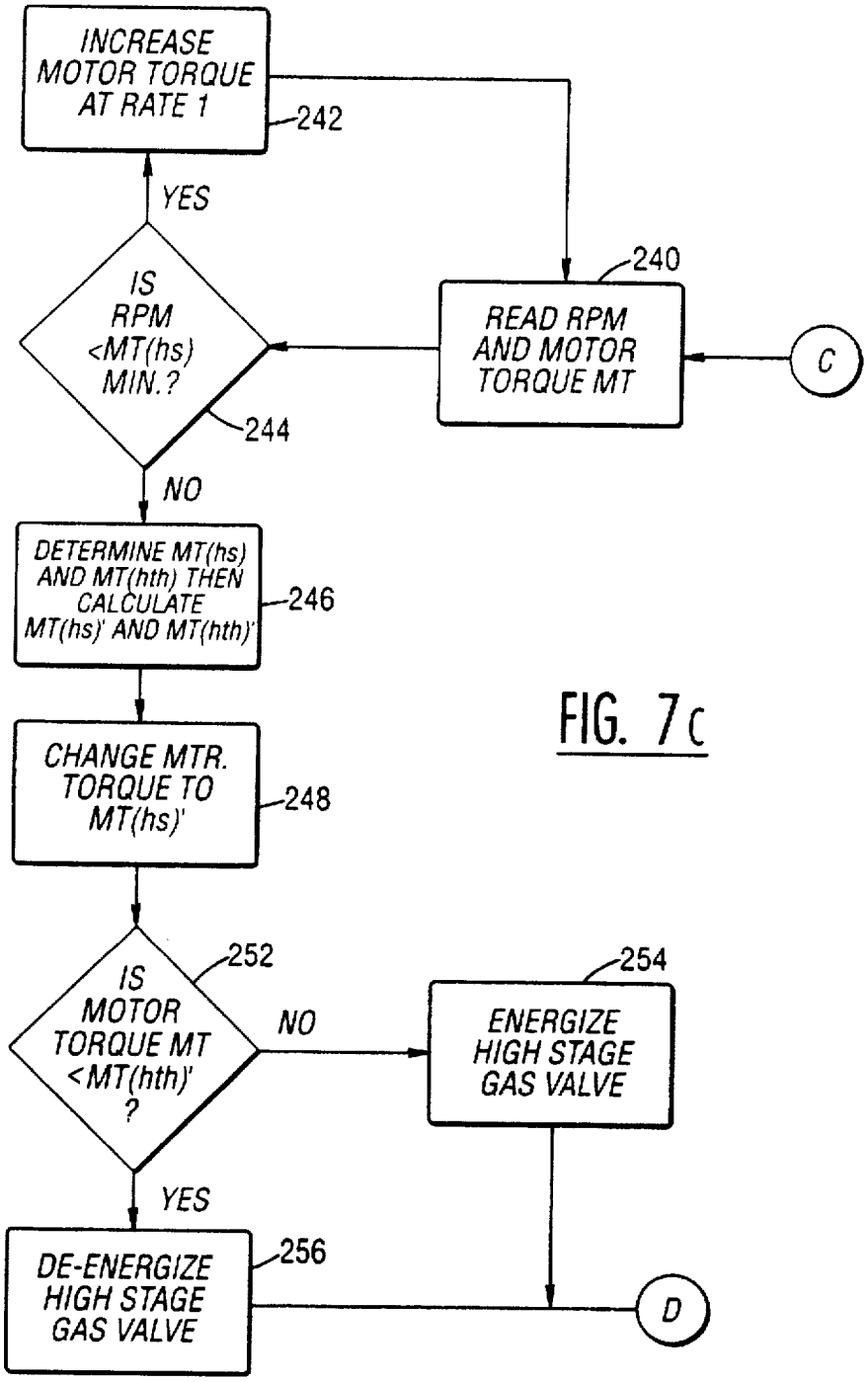
Figure 7D:
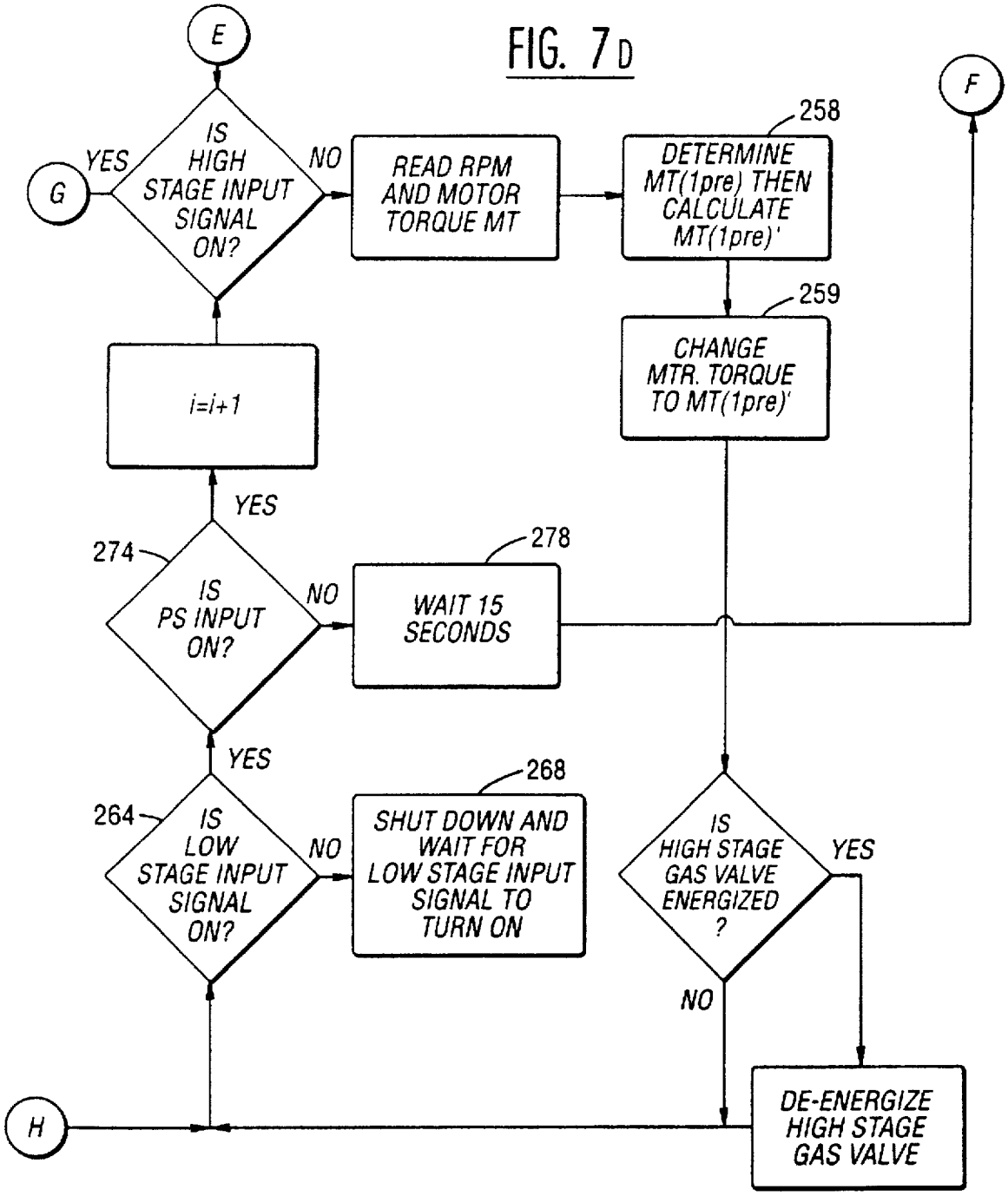

Referring specifically to the flow diagram segment of FIG. 7*a*, a call for heat is signaled by the low input signal turning on or activating, commonly as a signal from the furnace control board, at step 212. The system responds by having the ICM inducer motor 24, which has been idle, immediately step up to a rate of about 15% FS motor torque, in step 214, and then accelerate at RATE1, which is about 2% FS motor torque/sec. in step 216. Thereafter, in step 217 the inducer motor determines if pressure switch 31 has turned on or has been activated, usually from a 24 VAC input line from pressure switch. Pressure switch 31 is set so as to be responsive to a pressure drop in the heat exchanger, and is selected so as to be commensurate with or above a theoretically minimum excess air level under low stage conditions. The theoretically minimum excess air level under low stage conditions varies depending of furnace size. However, the pressure at which pressure switch 31 closes is independent of furnace size. Thereby, the motor RPM and motor torque MT at which switch 31 closes yield information regarding furnace size for use in control of the furnace.

When pressure switch 31 closes, the inducer motor microprocessor reads motor speed and torque (switch closing motor speed and torque) at step 218. In step 219, the inducer motor microprocessor determines a value for MT(ref) by looking up the value from adaptive-method lookup table 200. Referring to FIG. 5, a value for MT(ref) is determined by looking up the value for MT(ref) on MT(ref) reference plot 208 that correlates with the motor speed at the time of switch closing. Thus, if pressure switch 31 closes at a RPM=2500, then MT (ref) will be about 50% FS as illustrated by point 220 of the lookup table shown in FIG. 5.

The torque value MT(ref) determined from reference plot 208 and the current motor torque, MT, which is read at the time of switch closing are used in determining DELTA, the torque biasing value which is given by:

$$DELTA=MT-MT(ref) \quad \text{Eq. 1}$$

The torque biasing value, DELTA, is used to bias all torques determined from lookup table 200. It can be seen from Eq. 1 that the size of the furnace will determine MT, the switch closing motor torque, and therefore will determine DELTA. Generally, larger than average (4 and 5 cell) furnaces will have a switch closing torque larger than the torque determined from MT(ref) plot and therefore will yield a positive sign DELTA. Smaller than average furnaces (2 and 3 cell furnaces) will have a switch closing torque less than the torque determined from lookup table 200 and therefore will yield a negative sign DELTA. Accordingly, torques determined from lookup table 200 will be biased upward (more torque) when larger furnaces are controlled, and torques determined from lookup table 200 will be biased downward (less torque) when the excess air level in smaller furnaces is controlled. With bias torque, DELTA, applied to all torques determined from lookup table 200, the plots of lookup table are made to approximate the plots in the dedicated-method lookup table for which the adaptive-method lookup table is constructed.

Figure 7E:
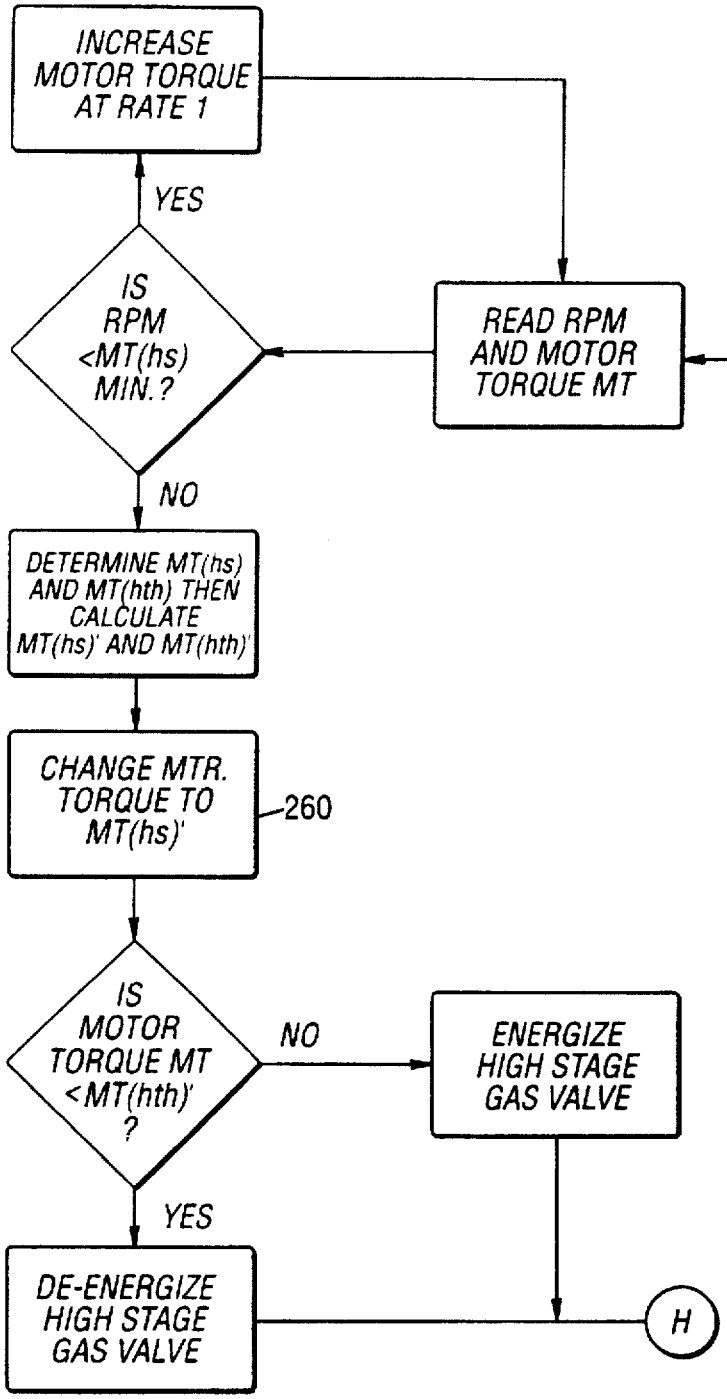

Referring again to the flow diagram of FIGS. 7*a* and 7*e* and specifically to FIG. 7*b* which illustrates pre-ignition control of a furnace controlled according to the method of the invention, a determination as to whether a call for high stage has been received is made in step 224. If a call for high stage has not been made then motor torque MT and RPM are read in step 226 and MT(lpre) is determined in step 228. Also in step 228, MT(lpre) is biased according to the torque biasing value, and becomes MT(lpre)' given by:

$$MT(lpre)'=MT(lpre)+DELTA \quad \text{Eq. 2}$$

In step 230 the excess air level of the furnace is controlled according to pre-ignition plot 210, as the torque value MT(lpre)' is applied to the motor. It will be recognized that application of biased torque MT(lpre)' from pre-ignition plot 210 will prevent low pressure switch 31 from opening before ignition takes place. Applying torque MT(lpre)' to motor 24 ensures that motor 24 will generate an excess air level (and a pressure) in the furnace higher than that seen at the time switch 31 makes. Note that MT(lpre) plot 210 on lookup table 200 is lower than MT(ref) plot 208, the torque corresponding to the switch closing condition. This result owes to the fact that inducer motor "overshoots" after switch 31 closes. Switch 31 closes when the motor torque is being stepped up at a high rate of about 2% per second at step 216. Therefore, the speed of motor 24 will continue to increase after switch 31 makes, and the stable operating torque achieved seconds after switch 31 makes will correspond to a higher speed (and furnace pressure) than the speed and pressure at the time the switch makes.

The remaining operating steps are essentially the same as in the dedicated system excess air level control system, except that the torque values applied to motor 24 determined from lookup table 200 are biased by the torque biasing value, DELTA, so that torques applied to motor 24 are appropriate for the size of the furnace used. Unlike steps 132 and 134 of the dedicated method, steps 232 and 234 determine whether high stage solenoid of gas valve 18 is energized. If high stage solenoid of gas valve 18 is energized, then high stage solenoid of gas valve 18 is de-energized in step 234.

During high stage operation, motor 24 is controlled according to step 248 which applies a biased high stage torque value, MT(hs)' to motor 24. MT (hth)' and MT(hs)' are determined in step 246 according to:

$$Mt(hth)'=MT(hth)+DELTA \quad \text{Eq. 3}$$

$$Mt(hs)'=MT(hs)+DELTA \quad \text{Eq. 4}$$

where MT(hth) and MT(hs) are determined from lookup table 200.

As in steps 140, 142 and 144 of the dedicated method, steps 240, 242, and 244 in the adaptive method of the invention continuously increase motor speed and determine if a minimum high stage speed is achieved. Program control does not proceed to step 246 until step 244 detects that a minimum high stage speed has been achieved.

Steps 252 and 254 and 256 control activation of the high stage solenoid in gas valve 18. The high stage gas valve is energized when current motor torque, MT, read in step 240 exceeds MT(hth)' determined in step 246 according to Eq. 3. The high stage gas valve is energized when the current torque exceeds the torque required for a minimally satisfactory excess air level in a high stage operating state.

If ignition occurs when the furnace is in high stage operation control of the motor is the same as before ignition, as indicated by the flow diagram segment of FIG. 7*e*.

Ignition is sensed when the burners are lit, as indicated in step 257. If ignition occurs when the furnace is in low stage operation, then control of the motor is according to the flow diagram segment of FIG. 7*d*.

Post-ignition low stage control of the motor is the same as pre-ignition low stage control of the motor except that the motor is controlled according to MT(ls)' and not MT(lpre)'. Mt(ls)' is calculated in step 258 according to $$MT(ls)'=MT(ls)+DELTA \quad \text{Eq. 5}$$

where MT(ls) is determined from lookup table 200. It is noted from adaptive-method lookup table 200 that the torque corresponding to MT(lpre) 210, the pre-ignition torque, is more than MT(ls), the post-ignition operating torque. This results because the load on inducer motor 24 decreases after ignition occurs because the density of the hot combustion products is quite a bit less than the density of air.

Step 262 associated with pre-ignition operation and step 264 associated with post-ignition operation determine if a signal shutting off the inducer motor has been received. If the low stage input signal is not on, then the motor shuts down according to step 266 or step 268 and program control shifts to 212, wherein the microprocessor waits for a low stage input signal to be received.

Step 272 associated with pre-ignition operation and step 274 associated with post-ignition operation determine if the pressure switch 31 opens during high stage or low stage operation of the furnace. Instances of the pressure switch 31 opening during combustion operating conditions should be rare since steps 230, 248, 259, or 260 will have controlled the torque applied to motor so the torque is above the torque causing opening of switch 31. Nevertheless, slight changes in flow restriction during operation of the furnace may cause a loss of pressure during combustion operation of the furnace, and therefore may cause pressure switch 31 to open. If the switch 31 opens during combustion operation of the furnace, then the motor waits 15 seconds (step 276 or 278) before ramping up speed at step 216 and testing again for switch activation at step 217.

While this invention has been explained with reference to the structure disclosed herein, it is not confined to the details set forth and this application is intended to cover any modifications and changes as may come within the scope of the following claims.

What is claimed is:

1. In an induced draft furnace having a heat exchanger, an ignition circuit, and an integrated control inducer motor having a fluctuating motor speed, an improved method of controlling the air combustion level in said furnace, said method comprising the steps of:

establishing a lookup table including (a) a combustion operating lookup plot wherein motor speed is correlated with torque values required to achieve desired combustion operation motor speeds at various flow restrictions and (b) a threshold combustion operating plot correlating current motor speed with minimum torque required for ignition;

determining whether a call for heat has been made; and upon determining that a call for heat has been made, controlling said motor by increasing the speed of said inducer motor until said motor exceeds a speed suitable for a combustion operating state and activating said ignition circuit when the current motor tongue exceeds said minimum torque from said lookup table, reading motor speed values from said motor, and maintaining a constant flow of air through said furnace by controlling the torque applied to said integrated control inducer motor in accordance with torque values from said lookup table correlated with said motor speed.

2. The method of claim 1, wherein said step of establishing a lookup table includes the steps of:

providing a test furnace;

operating said test furnace under changing flow restrictions; and recording motor speed and corresponding torques commensurate with desired excess air level while said furnace is operated.

3. The method of claim 1, wherein said step of establishing a lookup table includes the steps of:

providing a test furnace;

operating said test furnace under changing flow restrictions;

recording motor speed and corresponding torques commensurate with desired excess air level while said furnace is operated, and said desired excess air level being determined on the basis of flue gas carbon monoxide concentration.

4. The method according to claim 1, wherein said establishing step includes the step of establishing several candidate lookup tables, each corresponding to a different furnace type, said method further including the step, after said establishing step, of choosing a lookup table from said several candidate lookup tables on the basis of which lookup tables corresponds to the actual furnace type.

5. The method according to claim 1, wherein said establishing step includes the step of establishing several candidate lookup tables, each corresponding to a different furnace type, said method further including the step, after said establishing step, of choosing a lookup table from said several candidate lookup tables on the basis of which lookup table corresponds to the actual furnace type, said choosing step comprising manually selecting a candidate lookup table corresponding to the actual furnace type.

6. The method according to claim 1, wherein said establishing step includes the step of establishing several candidate lookup tables, each corresponding to a different furnace type, said method further including the step, after said establishing step, of choosing a lookup table from said several candidate lookup tables on the basis of which lookup table corresponds to the actual furnace type, said choosing step including the step of sensing features of said furnace using a sensor, and choosing said lookup tables on the basis of said features.

7. In an induced draft furnace having a heat exchanger, an ignition circuit, and an integrated control inducer motor having a fluctuating motor speed, an improved method of controlling the air level in said furnace, said method comprising the steps of:

establishing a lookup table wherein motor speed is correlated with torque values required to achieve desired combustion operation motor speeds at various flow restrictions: wherein said step of establishing a lookup table includes the steps of:

a) providing several test furnaces, each corresponding to a different furnace size;

b) operating each of said test furnaces under changing flow restrictions;

c) recording motor speed and corresponding torques commensurate with desired excess air levels for each of said furnaces while each of said furnaces is operated, said desired excess air levels being determined on the basis of flue gas carbon monoxide concentration; and d) averaging the recorded torque values recorded at the various motor speeds to establish an adaptive lookup table;

determining whether a call for heat has been made; and upon determining that a call for heat has been made, controlling said motor by increasing the speed of said inducer motor until said motor exceeds a speed suitable for a combustion operating state, reading motor speed values from said motor, and maintaining a constant flow of air through said furnace by controlling the torque applied to said integrated control inducer motor in accordance with torque values from said lookup table correlated with said motor speed.

8. The method of claim 7, wherein said furnace further includes a pressure switch selected to open at an opening pressure at or above a theoretically minimum excess air level, said furnace having a closing pressure, said closing pressure determining a torque biasing level of said furnace based on a reading of said motor RPM and torque when said pressure switch closes.

9. The method of claim 7, wherein said furnace further includes a pressure switch selected to open at an opening pressure at or above a theoretically minimum excess air level, and wherein said controlling step including the step of running said motor at a speed sufficient to avoid opening of said switch.

10. The method of claim 7, wherein said furnace further includes a pressure switch selected to open at an opening pressure commensurate with or above a theoretically minimum excess air level, said pressure switch having a closing pressure determined by the size of said furnace, wherein said torque values correlated with motor speed are averaged torque values for an average-sized furnace, and wherein said controlling step further includes the step of biasing said established torque values by an amount determined by said closing pressure so that said averaged torque values are biased according to the actual size of said furnace.

11. In an induced draft, two-stage furnace having a heat exchanger, an ignition circuit, a high stage gas valve, and an integrated control inducer motor having fluctuating motor speed, an improved method of controlling the combustion excess air level in said furnace, said method comprising the steps of:

establishing a lookup table including (a) a first combustion operating lookup plot correlating motor speed with first torque values required for achieving a desired low stage excess air level, (b) a second combustion operating lookup plot correlating motor speed with second torque values required for achieving desired high stage excess air level and (c) at least one threshold operating plot correlating current motor speed with minimum torque required for ignition;

determining whether a call for low stage has been made;

upon determining that a call for low stage has been made, controlling said motor by (a) increasing the speed of said inducer motor and activating said ignition circuit when the current motor torque exceeds said minimum torque from said lookup table and (b) maintaining a constant flow of air through said furnace in a low stage operating state by controlling the torque applied to said motor in accordance with said first torque values from said lookup table, and determining whether a call for high stage has been made; and upon determining that a call for high stage has been made, maintaining a constant flow of air through said furnace in a high stage operating state by controlling the torque applied to said motor in accordance with said second torque values.

12. The method of claim 11, wherein said establishing step includes the steps of:

providing a test furnace;

operating said test furnace under changing flow restriction; and recording motor speed and corresponding torques commensurate with desired excess air level while said furnace is operated.

13. The method of claim 11, wherein said establishing step includes the steps of:

providing a test furnace;

operating said test furnace under changing flow restriction; and recording motor speed and corresponding torques commensurate with desired excess air level while said furnace is operated, said desired excess air level determined on the basis of flue gas carbon monoxide concentration.

14. The method according to claim 11, wherein said establishing step includes the step of establishing several candidate lookup tables, each corresponding to a different furnace type, said method further including the step, after said establishing step, of choosing a lookup table from said several candidate lookup tables on the basis of which lookup table corresponds to the actual furnace type.

15. The method according to claim 11, wherein said establishing step includes the step of establishing several candidate lookup tables, each corresponding to a different furnace type, said method further including the step, after said establishing step, of choosing a lookup table from said several candidate lookup tables on the basis of which lookup table corresponds to the actual furnace type, said choosing step comprising manually selecting a candidate lookup table corresponding to the actual furnace type.

16. The method according to claim 11, wherein said establishing step includes the step of establishing several candidate lookup tables, each corresponding to a different furnace type, said method further including the step, after said establishing step, of choosing a lookup table from said several candidate lookup tables on the basis of which lookup table corresponds to the actual furnace type, said choosing step including the step of sensing features of said furnace using a sensor, and choosing said lookup tables on the basis of said features.

17. In an induced draft furnace having a heat exchanger, an ignition circuit, and an integrated control inducer motor having a fluctuating motor speed, an improved method of controlling the combustion air level in said furnace, said method comprising the steps of:

establishing a lookup table wherein motor speed is correlated with torque values required to achieve desired combustion operation motor speeds at various flow restrictions; wherein said establishing step includes the steps of:

(a) providing a plurality of test furnaces, each corresponding to a different furnace size;

(b) operating each of said test furnaces under changing flow restrictions;

(c) recording motor speed and corresponding torques commensurate with desired excess air levels for each of said furnaces while each of said furnaces is operated, said desired excess air levels determined on the basis of flue gas carbon monoxide concentration; and (d) averaging the recorded torque values recorded at the various motor speeds seen during operation of said plurality of furnaces to establish an adaptive lookup table;

determining whether a call for heat has been made; and upon determining that a call for heat has been made, controlling said motor by increasing the speed of said inducer motor until said motor exceeds a speed suitable for a combustion operating state, reading motor speed values from said motor, and maintaining a constant flow of air through said furnace by controlling the torque applied to said integrated control inducer motor in accordance with torque values from said lookup table correlated with said motor speed.

18. The method of claim 17, wherein said lookup table includes a threshold high stage operating plot correlating current motor speed with minimum torque required for high stage operation, and wherein said controlling step further includes the step of activating said high stage valve when the current motor torque of said motor exceeds said minimum torque from said lookup table.

19. The method of claim 17, wherein said furnace further includes a pressure switch selected to open at an opening pressure at or above a theoretically minimum excess air level, said furnace having a closing pressure, said closing pressure determining a torque biasing level of said furnace based on a reading of said motor RPM and torque when said pressure switch closes.

20. The method of claim 17, wherein said furnace further includes a pressure switch selected to open at an opening pressure at or above a theoretically minimum excess air level, said controlling step including the step of running said motor at a speed sufficient to avoid opening of said switch.

21. The method of claim 17, wherein said furnace further includes a pressure switch selected to open at a opening pressure commensurate with or above a theoretically minimum excess air level, said pressure switch having a closing pressure determined by the size of said furnace, wherein said torque values correlated with motor speed are averaged torque values for an average-sized furnace, and wherein controlling step further includes the step of biasing said established torque values by an amount determined by said closing pressure so that said averaged torque values are biased according to the actual size of said furnace.

* * * * *